United States Patent [19]

Schroter-Dommes et al.

[11] 4,014,260

[45] Mar. 29, 1977

[54] REMOVABLE GUARD ON CYLINDERS OF PRINTING PRESSES

[75] Inventors: Wilhelm Schröter-Dommes, Ludwigshafen; Wilfried Vogt, Walldorf, both of Germany

[73] Assignee: Heidelberger Druckmaschinen Aktiengesellschaft, Heidelberg, Germany

[22] Filed: Nov. 13, 1975

[21] Appl. No.: 631,682

[30] Foreign Application Priority Data

May 10, 1975 Germany ..... 2520920

[52] U.S. Cl. ..... 101/212; 101/415.1

[51] Int. Cl.[2] ..... B41F 13/08

[58] Field of Search ..... 101/415.1, 378, 212, 101/216

[56] References Cited

UNITED STATES PATENTS 2,103,617 12/1937 Gericke ..... 101/415.1

2,366,930 1/1945 Pirie ..... 101/415.1 X

FOREIGN PATENTS OR APPLICATIONS 515,657 12/1939 United Kingdom ..... 101/415.1

*Primary Examiner*—J. Reed Fisher

*Attorney, Agent, or Firm*—Herbert L. Lerner

[57] ABSTRACT

Removable guard on a printing press cylinder formed with a cylinder gap and having end plates at the axial ends thereof includes cover means having a longitudinal split therein, and spring means carried by the cover means, the cover means being yieldingly foldable along the split against the biasing force of the spring means and insertable into the cylinder gap wherein it is unfoldable along the split under the biasing force of the spring means and engageable with the cylinder end plates so as to cover and bridge the cylinder gap.

6 Claims, 3 Drawing Figures

REMOVABLE GUARD ON CYLINDERS OF PRINTING PRESSES

The invention of the instant application relates to a removable guard on cylinders of printing presses for covering and bridging the cylinder gap or channel.

It is generally known that the gaps of the rotating cylinders of a printing press constitute sources of danger which demand increased attention of the operator and can lead to serious accidents, for example, when the cylinders are being cleaned while the press is running. In accordance with safety regulations issued by the employers' liability insurance association in Germany, for example, cylinder gaps must therefore be covered while the cylinder is rotating.

Especially, the case of large cylinder gaps, which may constitute up to one third of the cylinder circumference, and in the case of an alternating cylinder arrangement, it is difficult to provide guards which can completely cover the cylinder gap yet be readily insertible into the gap. One of the difficulties arises from the provision, also in accordance with safety regulations, of spindles or rods as finger guards in front of the clearances or nips between the cylinder provided with the gap and adjacent cylinders cooperating therewith since the spacing therebetween can be considerably smaller than the dimension of a large cylinder gap, with the result that it becomes extremely difficult to insert a unipartite guard into the cylinder.

To avoid these difficulties, bipartite protective devices have become known heretofore, which are separately inserted, sequentially into the cylinder gap. The disadvantage of such a device is that twice the time is required to insert the bipartite device into and remote it from the cylinder than would be necessary if a unipartite guard were used. Consequently, the risk exists that the entire protective device may come to be regarded by the operating personnel as an unnecessary complication and may not be used at all after awhile.

It is accordingly an object of the invention to provide a readily manipulatable guard which is suitable for covering large cylinder gaps yet, nevertheless, can be easily passed through narrow interspaces without any trouble or problem and is simply and quickly insertable into and removable from the cylinder gap.

With the foregoing and other objects in view, there is provided in accordance with the invention a removable guard on a printing press cylinder formed with a cylinder gap and having end plates at the axial ends thereof, comprising cover means having a longitudinal split therein, and spring means carried by the cover means, the cover means being yieldingly foldable along the split against the biasing force of the spring means and insertable into the cylinder gap wherein it is unfoldable along the split under the biasing force of the spring means and engageable with the cylinder end plates so as to cover and bridge the cylinder gap. Owing to the foldable construction, even large cylinder gaps can be completely bridged over without any difficulty arising with respect to the insertion of the cylinder gap cover into the cylinder gap. Nor is there any problem presented in the introduction of the cover into the cylinder gap when the spacing between the guard rods or spindles disposed in front of the spaces or nips between the cylinders is far smaller than the size of the cylinder gap or when the cylinder formed with the gap is disposed in a laterally offset or staggered position between two other cylinders.

In accordance with another feature of the invention, the cover means comprise a pair of arcuate cover plates, hinge means are provided connecting cover plates along respective mutually adjacent longitudinal sides thereof, and leaf spring means are provided extending from one of the cover plates to the other transversely to the longitudinal sides thereof.

In accordance with a further feature of the invention the hinge means are a piano-style butt hinge extending along the length of the mutually adjacent longitudinal sides of the arcuate cover plates, and the leaf spring means comprise a leaf spring extending across the middle of the cover plates transversely to the hinge.

To engage the guard to be manipulated easily and rapidly inserted into and removed from the end plates of the cylinder, in accordance with additional features of the invention, each of the cover plates has a pair of opposite narrower sides transverse to the longitudinal side thereof, the mutually adjacent narrower sides of the cover plates on one side of the cover means each carrying a fixed locking pin extending in longitudinal direction, the opposite narrower sides of the cover plates respectively carrying a spring-biased guide pin movable in longitudinal direction and a fixing pin fixed against movement longitudinally and having a ball-shaped head formed with a step-wise reduced diameter for insertion in a corresponding recess formed in a respective cylinder end plate.

In accordance with an added feature of the invention, the locking pins and the guide pin are formed with substantially conical free ends.

In accordance with yet another feature of the invention, the cover means is formed with a plurality of finger-gripping holes located opposite one another in the pair of cover plates.

In accordance with a concomitant feature of the invention, at least four of the finger-gripping holes are formed in the cover means, two in each cover plate opposite the mutually adjacent longitudinal sides thereof.

Other features which are considered as characteristic for the invention are set forth in the appended claims.

Although the invention is illustrated and descirbed herein as embodied in a removable guard on cylinders of printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
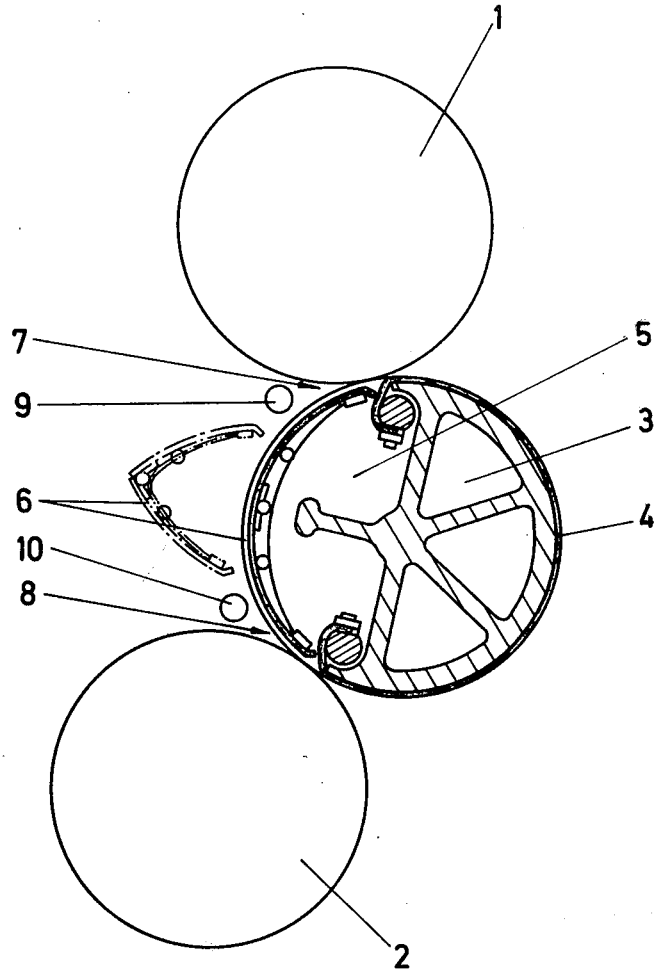
FIG. 1 is a schematic view of a cylinder assembly of a printing unit showing the rubber-covered or blanket cylinder in cross section, and a cylinder gap cover constructed in accordance with the invention both in the installed position thereof as shown in solid lines and also while it is being removed or inserted as shown in phantom.

Referring now to the drawing and first, particularly, to FIG. 1 thereof, there is shown disposed between a plate cylinder 1 and an impression cylinder 2, and laterally offset from these cylinders, a blanket cylinder 3 that is provided with a rubber blanket 4. The blanket cylinder 3 is formed with a channel or gap 5 which extends over about one third of its circumference and consequently has a circular measure of approximately 120°. The cylinder gap 5 is covered by a cylinder gap cover 6 constructed in accordance with the invention. Finger guard spindles or rods 9 and 10 are disposed in front of the clearances or nips 7 and 8 formed conjointly by the plate cylinder 1 and the blanket cylinder 3, on the one hand, and also the impression cylinder 2 and the blanket cylinder 3, on the other hand.

Figure 3:
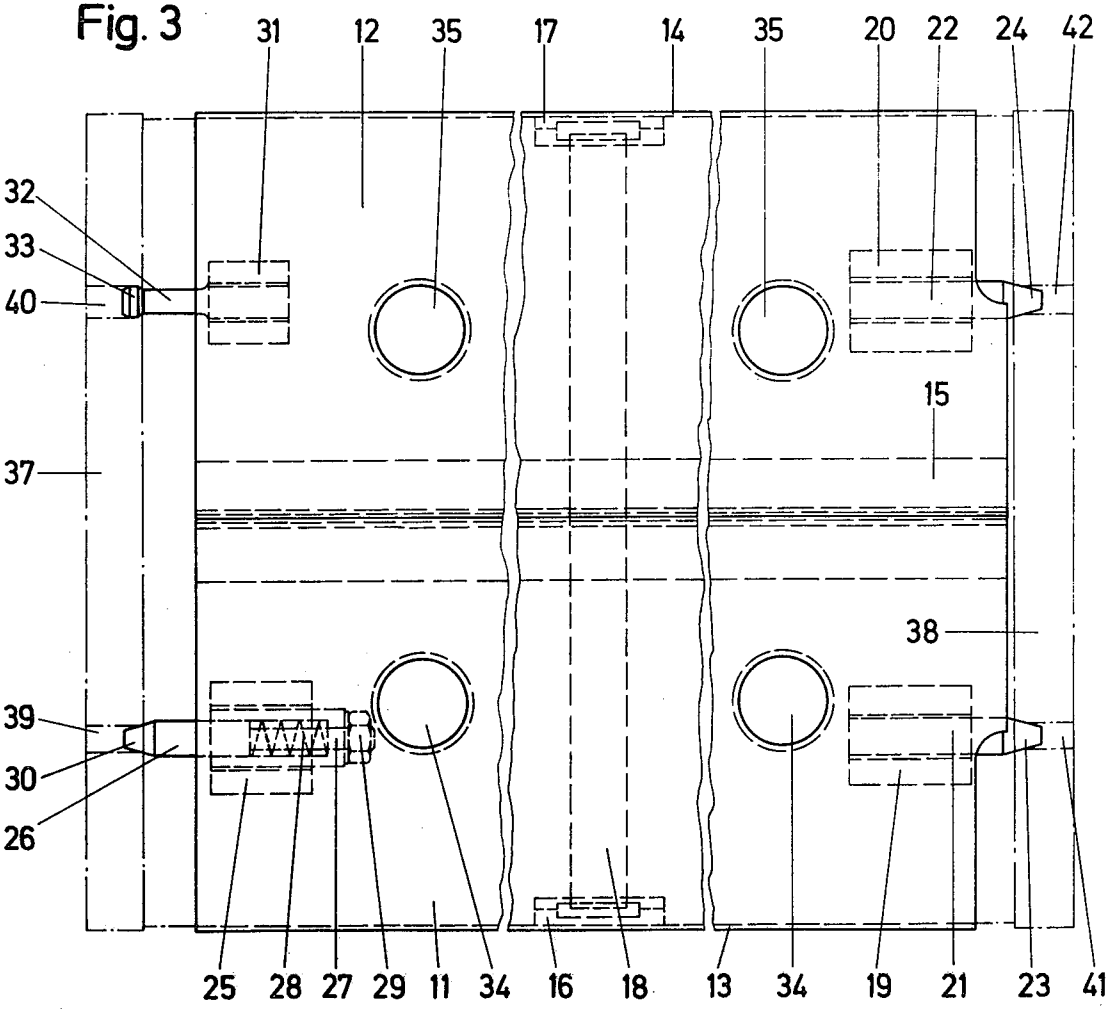
FIG. 3 is a plan view of FIG. 2 showing the cylinder gap cover installed in a gap between the cylinder end plates.
Figure 2:
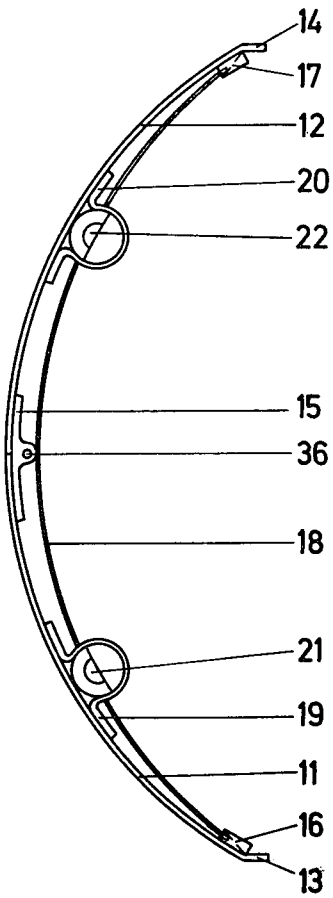
FIG. 2 is an enlarged side elevational view of the cylinder gap cover.

As shown more clearly in FIGS. 2 and 3, the cylinder gap cover 6 is formed of two individual cover plates 11 and 12 or circular arcuate shape, the ends 13 and 14 of which are flattened in longitudinal direction (FIG. 3). The arcuate cover plates 11 and 12 are connected to one another longitudinally by means of a piano-type butt hinge 15. About the middle of the cover plates 11 and 12 and close to the outer longitudinal sides thereof and in front of the flattened ends 13 and 14 thereof, spring holders 16 and 17 are secured, the respective ends of a leaf spring 18 being inserted therein transversely to the piano-type butt hings 15.

Guiding eyes 19 and 20 are secured, respectively, to the end of one narrow side of each of the two cover plates 11 and 12, in which two locking pins 21 and 22 are firmly and fixedly inserted. The ends 23 and 24 of the locking pins 21 and 22 are conically formed. On this narrow side of the respective cover plates 11 and 12, the edges of the cover plates 11 and 12 are recessed to the middle of the locking pins 21 and 22.

Before the edge of the other narrow side of the cylinder gap cover 6 a guide bushing 25 is secured to the cover plate 11, a guide pin 26 having a reduced diameter stem 27 being axially displaceably inserted therein. Disposed on the guide pin stem 27 of reduced diameter, is a compression spring 28, and a nut 29 is screwed on the rear end thereof and serves to prestress the compression spring 28. The nut 29 is secured against rotation by conventional means and protects the guide pin 26 against expulsion axially from the guide bushing 25. Moreover, the forward or free end 30 of the guide pin 26 is also conically formed. On the same side of the cylinder gap cover 6, the cover plate 12 is provided at the edge of the narrow side thereof with a pin holder 31 into which a fixing pin 32 is inserted. The free end of the fixing pin 32 has a larger diameter than the stem per se thereof and is formed with a spherical or ball-shaped head 33 which is stepwise reduced in diameter. Two pairs of opposing finger-gripping holes 34 and 35, respectively, are formed in front of the guide eye 19 and the guide bushing 25, respectively, in the cover plate 11 and the cover plate 12.

The operation of the foregoing device according to the invention is as follows:

To insert the cylinder gap cover 6 into the gap 5 of the blanket cylinder 3, the cover 6 is grasped by both hands, with two fingers of each hand in the respective opposite gripping holes 34 and 35. Depending upon the available intermediate space through which the cylinder gap cover 6 has to be passed in order to insert it into the cylinder gap 5, the cover 6 is folded together about the pivot 36 of the piano-type butt hinge 15, using the finger pressure of both hands against the biasing force of the leaf spring 18, and then the folded cover 6 is passed between the finger guard spindles or rods 9 and 10. The spring force can be varied, of course, by using leaf springs 18 of different strength. The moment the cylinder gap cover 6 is located in a position behind the finger guard spindles 9 and 10, the finger pressure can be removed so that the cylinder gap cover 6 can unfold again to the full extent thereof.

The insertion of the cylinder gap cover 6 into the end plates 37 and 38 of the blanket cylinder 3 is effected in the following manner:

The cone 30 of the guide pin 26 is initially inserted into the bore 39 and the stepwise reduced ball head 33 into a bore 40 formed in the end plate 37 of the blanket cylinder 3. Then the cylinder gap cover 6 is shifted axially against the biasing force of the compression spring 28 in direction towards the end plate 37 until the conical ends 23 and 24 of the locking pins 21 and 22 can be inserted into bores 41 and 42 formed in the end plate 38 of the blanket cylinder 3. It is of particular advantage that the cylinder gap cover 6 can not only be shifted axially, but can also be tilted in all direction due to the conically reduced end of the guide pin 26 and the stepwise reduced ball head 33 of the fixing pin 32, so that the introduction of the locking pins 21 and 22 into the bores 41 and 42 can be effected relatively easily.

To remove the cylinder gap cover 6, the same operation as in the foregoing can be carried out except that they would be in reverse only.

By using the afore-described cylinder gap cover, the special advantage is provided of having a more independent choice of cylinder arrangement with correspondingly more clearance for movement, so as to strive for an ideal arrangement of the cylinders without having to consider the cylinder gaps and the legally provided covering therefor. It is also possible thereby to obtain a cylinder arrangement wherein the midpoints of the blanket and the plate cylinders lie approximately vertically above one another and the midpoint of the impression cylinder is offset relative to the first mentioned midpoints, providing the advantage of a large looping angle or arc of sheet contact immediately after printing.

The field of use of the cylinder gap cover 6 is naturally not restricted to the covering of the gaps of blanket cylinders; obviously, the gaps of other cylinders, such as plate cylinders, for example, may be covered equally well thereby.

We claim:

1. Manually removable guard on a printing press cylinder formed with a cylinder gap and having end plates at the axial ends thereof, comprising a pair of arcuate cover plates having respective concave and convex faces, means forming an articulating connection of said cover plates along respective mutually adjacent longitudinal sides thereof so that said cover plates are foldable concave face-to-concave face along said adjacent longitudinal sides thereof, and a leaf spring extending from one to the other of said cover plates transversely to said longitudinal sides thereof and adjacent the respective concave faces thereof, said leaf spring prestressing said plates into a substantially circular arcuate configuration corresponding to that of the cylindrical surface of the printing press cylinder, said cover plates being manually yieldingly foldable concave face-to-concave face along said adjacent longitudinal sides thereof and together with said leaf spring against the prestressing biasing force of the latter and engageable with the end plates of the printing press cylinder so as to cover and bridge the cylinder gap.

2. Removable guard according to claim 1 wherein said means forming an articulating connection are a piano-style butt hinge having articulating joint portions alternatingly connected to the respective cover plates along substantially the entire length of said mutually adjacent longitudinal sides of said arcuate cover plates, and said leaf spring extends across the middle of said cover plates transversely to said hinge.

3. Removable guard according to claim 2 wherein each of said cover plates has a pair of opposite narrower sides transverse to said longitudinal side thereof, the mutually adjacent narrower sides of said cover plates on one side thereof each carrying a fixed locking pin extending in longitudinal direction, the opposite narrower sides of said cover plates respectively carrying a spring-biased guide pin movable in longitudinal direction and a fixing pin fixed against movement longitudinally and having a ball-shaped head formed with a step-wise reduced diameter for insertion in a corresponding recess formed in a respective cylinder end plate.

4. Removable guard according to claim 3 wherein said locking pins and said guide pin are formed with substantially conical free ends.

5. Removable guard according to claim 1 wherein said pair of cover plates is formed with a plurality of finger-gripping holes located opposite one another in said pair of cover plates.

6. Removable guard according to claim 5 wherein at least four of said finger-gripping holes are formed in said pair of cover plates, two in each cover plate opposite said mutually adjacent longitudinal sides thereof.

* * * * *